US007188764B2

(12) United States Patent
Penuela

(10) Patent No.: US 7,188,764 B2
(45) Date of Patent: Mar. 13, 2007

(54) METHOD FOR EFFECTING TICKET-BASED TRANSACTIONS USING A WRISTBAND

(75) Inventor: Oswaldo Penuela, Santa Clarita, CA (US)

(73) Assignee: Precision Dynamics Corporation, San Fernando, CA (US)

( * ) Notice: Subject to any disclaimer, the term of this patent is extended or adjusted under 35 U.S.C. 154(b) by 92 days.

(21) Appl. No.: 11/015,659

(22) Filed: Dec. 16, 2004

(65) Prior Publication Data

US 2006/0131391 A1 Jun. 22, 2006

(51) Int. Cl.
*G07B 15/02* (2006.01)

(52) U.S. Cl. ..... 235/384; 235/375

(58) Field of Classification Search ..... 235/384, 235/375, 487, 382, 378; 283/74, 70, 81, 283/100

See application file for complete search history.

(56) References Cited

U.S. PATENT DOCUMENTS

| | | | | |
|---|---|---|---|---|
| 3,660,916 | A | 5/1972 | McDermott et al. | |
| 3,698,383 | A | 10/1972 | Baucom | |
| 3,771,717 | A | 11/1973 | McDermott et al. | |
| 4,134,320 | A | 1/1979 | Oya | |
| 4,145,966 | A | 3/1979 | Peterson et al. | |
| 4,221,063 | A | 9/1980 | Charles et al. | |
| 5,071,168 | A | 12/1991 | Shamos | |
| 5,479,797 | A | 1/1996 | Peterson | |
| 5,609,716 | A | 3/1997 | Mosher, Jr. | |
| 5,615,504 | A | 4/1997 | Peterson et al. | |
| 5,653,472 | A | 8/1997 | Huddleston | |
| 5,785,354 | A * | 7/1998 | Haas | 283/74 |
| 5,792,299 | A | 8/1998 | Mosher, Jr. | |
| 5,799,426 | A | 9/1998 | Peterson | |
| 5,921,547 | A * | 7/1999 | Wilner | 273/139 |
| 5,973,600 | A | 10/1999 | Mosher, Jr. | |
| 5,979,941 | A | 11/1999 | Mosher | |
| 6,067,739 | A | 5/2000 | Riley | |
| 6,100,804 | A | 8/2000 | Brady et al. | |
| 6,234,477 | B1 * | 5/2001 | Scrymgeour et al. | 273/139 |
| 6,438,881 | B1 | 8/2002 | Riley | |
| 6,510,634 | B1 | 1/2003 | Riley | |
| 6,923,445 | B2 * | 8/2005 | Such | 273/269 |
| 6,945,464 | B2 * | 9/2005 | Jackson | 235/487 |
| 7,000,951 | B2 * | 2/2006 | Valenti, Jr. | 283/74 |
| 2003/0011190 | A1 | 1/2003 | Ryan | |
| 2003/0218331 | A1 * | 11/2003 | Yesser | 283/106 |
| 2004/0164544 | A1 | 8/2004 | Thall | |
| 2005/0108912 | A1 * | 5/2005 | Bekker | 40/633 |

* cited by examiner

*Primary Examiner*—Thien M. Le
*Assistant Examiner*—Edwyn Labaze
(74) *Attorney, Agent, or Firm*—Kelly Lowry & Kelley LLC

(57) ABSTRACT

A process for effecting ticket-based transactions includes attaching a band to a definite object. The band for carrying out the process has a plurality of removable tickets with each ticket bearing band-specific indicia usable in effecting a transaction. During the process, the band is associated with the definite object in an electronic database so that when a ticket is removed from the band to effect a transaction, the ticket is utilized to record the transaction in the electronic database.

39 Claims, 8 Drawing Sheets

METHOD FOR EFFECTING TICKET-BASED TRANSACTIONS USING A WRISTBAND

BACKGROUND OF THE INVENTION

This invention relates to identification bracelets or bands which are widely used in a variety of applications. More particularly, the present invention relates to bracelets or bands with tickets.

Identification bracelets are commonly utilized in crowd control contexts such as amusement parks, ski lifts, and rock concerts. They are applied to the wrists of the persons visiting the amusement park, utilizing the ski lift, or attending the concert in order to identify the customer and prevent various abuses which arise where large numbers of individuals congregate.

Identification bracelets have also been used in hospital or medical clinics. Initially, such wristbands were confined to providing the bare minimum of the patient's name and, possibly, of the patient's illness. In crowd control situations, the wristband was utilized to indicate the admissibility of the individual wearing the band and, frequently, the duration, by color indication, of the attendance period of the person wearing the wristband. For instance, the bracelet for a concert can incorporate visually perceptible information regarding seat assignments; for amusement parks, the number of rides to which the individual is entitled; and, for ski lifts, the numbers of lifts and the numbers of rides to which the individual is entitled Various types of prior art bracelets have been utilized in the above-mentioned situations, including bracelets fabricated from plastic sheet materials such as vinyl and various forms of plastic reinforced papers wherein the cellulosic content of the papers is bonded and strengthened by the plastic binder.

Some prior art bracelets include electronic information receptor means, such as magnetic strips or the like, and the information is imparted to the magnetic strip by corresponding electronic information conveyors. Additional or alternative information regarding the extension of credit or spending limit available to an individual may be incorporated in the information imparted to the bracelet. Other bracelets incorporate bar coding as a method of conveying information regarding the individual and the extent of his purchases. A bar code reader may be used to 'read' the bracelet and pull up information regarding the wearer of the bracelet from a main database containing information about the wearer of the bracelet such as name, room number, duration of stay, extension of credit or spending limit available.

Labels have been used in conjunction with wristbands. For example, U.S. Pat. No. 3,660,916 discloses an identification system that provides labels in a rectangular dispenser located on top of a wristband. However, the receptacle renders the wristband an unwieldy device that would have to be uncomfortable for the wearer, bulky and inconvenient. In another example, U.S. Pat. No. 3,698,383 discloses a recipient identification band, labels and a sample tube for use in handling blood procedures. However, the identification system is limited in its use and comes in several pieces which provides inconvenience and discomfort to the wearer of the band, who must deal with this extended tail of labels until such time as the tear-offs are used or otherwise disposed of, the tear-offs being prone to ripping across the succeeding label.

Accordingly, there is a need for an identification band with associated tickets that are available for a variety of uses. There is a further need for an identification band that is formed as a single-piece with the tickets. There is also a need for an identification band that stores tickets in a compact manner pending use. There is an additional need for an identification band with detachable tickets that can be used for promotional purposes. There is a further need for an identification band with detachable tickets that can be used for tracking purposes. There is also a need for an identification band with detachable tickets that can be used for cross-identification of objects. There is an additional need for an identification band with detachable tickets that can be used for matching an article with its owner. The present invention fulfills these needs and provides other related advantages.

SUMMARY OF THE INVENTION

The present invention provides an identification band with associated tickets that are available for a variety of uses. The identification band is formed as a single-piece with the tickets and stores the tickets in a compact manner pending use. The present invention provides an identification band with detachable tickets that can be used for various purposes including, without limitation, promotional purposes, tracking purposes, advertising, cross-identification of objects, and matching an article with its owner. The present invention also provides a wristband that is a cost-efficient appliance and system characterized by convenience, wearer comfort, multiple-use capabilities, and the security and identification integrity of one-piece manufacture.

In accordance with an embodiment of the present invention, a process for effecting ticket-based transactions includes attaching a band to a definite object. The band has a plurality of removable tickets with each ticket bearing band-specific indicia usable in effecting a transaction. The band is associated with the definite object in an electronic database. A ticket is removed from the band to effect a transaction and the ticket is utilized to record the transaction in the electronic database.

During utilization of the ticket, the removed ticket is scanned with a reader. When the ticket is removed, the ticket can be redeemed for goods or services and this can include exchanging the ticket for a discount on the goods or services.

During the process, the band is read to identify the definite object. The reading of the band can include scanning the band to identify the definite object.

The removed ticket can be attached to an article during the process. The definite object can also be cross-referenced with the article. During cross-referencing step, the band-specific indicia of the ticket can be compared with indicia on the band. Also, cross-referencing can include comparing electronic information stored within the band with electronic information stored within the ticket.

The process can be used in a number of different transactions. For example, the transaction can comprise checking-in the article and then later claiming the article. In another example, the transaction comprises testing the article and entering test results into the database.

As part of utilizing the ticket, the ticket can be cross-referenced with the band during the transaction. Utilization of the ticket also includes the ticket being able to be cross-referenced with the database during the transaction.

The tickets can be removed from the bands in a number of ways. For example, a portion of a top layer of the band can be removed in order to remove the ticket for effecting the transaction. In another example, a portion of a top layer of the band can be removed to access the ticket for effecting the transaction.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

The present invention resides in a process for effecting ticket-based transactions using a wristband bearing detachable tickets. The tickets allow the wearer of the wristband to engage in various transactions that include, without limitation, the promotion of goods or services, the tracking of objects, the cross-identification of objects, and the matching an article with its owner. Pre-designed tickets are employed as part of the process. During manufacture of the wristband, one or more tickets are built into the band itself and, after the band is attached to a wearer, the ticket(s) are detached by fingernail leverage and used for a variety of purposes. For example, a wristband with detachable tickets can be used as an identification appliance system for medical, security and commercial tracking purposes. These pre-designed tickets are employed as part of the process in cross-identification of objects, articles and the like using pre-defined electronic codes and/or printed indicia. The inherent nature of the band's construction carries with it a system of secured transport and, if so desired, cross-referencing information between the wearer of the band and the tickets detached from the band. As a matter of security, the tickets are carried with the band until detached: as long as the ticket is attached to the band, there is no danger of mixing the tickets or losing them. At its simplest, the band/ticket combination provides a visible indication of usage: as tickets are detached, the band will show the absence of the tickets. On a more sophisticated level, the band/ticket combination can be configured to carry complex, electronically read/written data within both the band and the tickets—which may then be detached, used elsewhere, and cross-referenced back to the wearer of the band. The manufacture of bracelets or wristbands for use as part of this process provides increased efficiency and cost-effectiveness.

Figure 1:
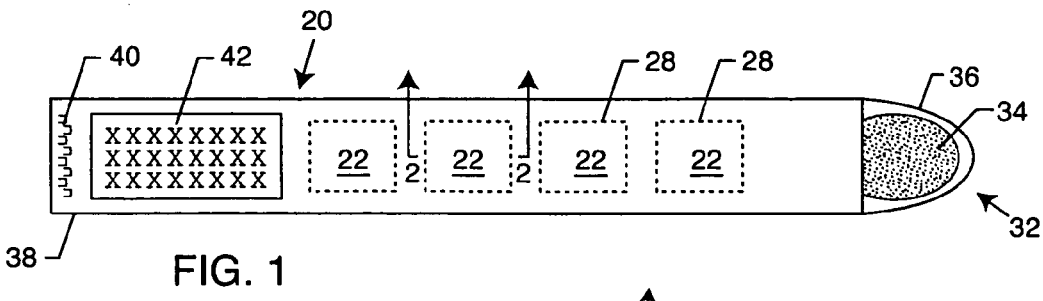
FIG. 1 is a top plan view of a wristband embodying the invention.
Figure 2:
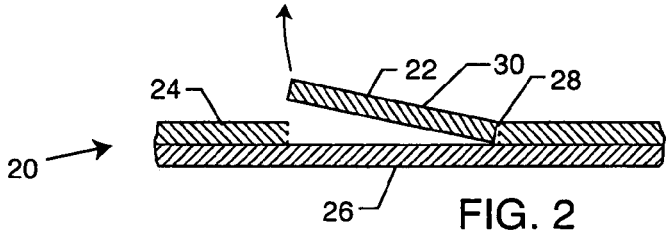
FIG. 2 is an enlarged sectional view taken generally along line 2—2 of FIG. 1.

As shown in FIGS. 1 and 2 for purposes of illustration, the present invention resides in a one-piece wristband 20 with detachable tickets 22 that can be used for a variety of purposes including, without limitation, promotional purposes, the purchase of goods or services, identification and tracking of objects, cross-referencing of objects and the like. The wristband 20 can be formed by a continuous lamination apparatus (not shown) that laminates together two layers or substrates (i.e., a top substrate 24 and a bottom substrate 26). The tickets 22 are part of the pre-formed top substrate 24. The substrates 24, 26 may be made of an engineering thermoformed plastic in the form of respective sheets or rolls (not shown) of web material that may include, without limitation, paper, polyester, a low-density polyethylene, low-cost polyolefin, or other suitable materials that will combine durability with—for the layer 26 closest to the wearer's skin—nonabrasive comfort to the wearer.

The top substrate 24 (i.e., the substrate further away from the skin and visible to eye when the band 20 is worn) may be opaque or transparent, may be printed upon, and is perforated 28 so that one or more sections 30 of the top substrate 24, in the form of the tickets 22 themselves, can be peeled off (FIG. 2) by the wearer or other authorized person. The perforations 28 that pierce the top layer 24 do not penetrate the bottom layer 26. The number and layout of tickets 22 may vary, as outlined below.

The attachment device 32 for the band 20 will be a pressure-activated adhesive 34 to assist the band 20 being tamper-resistant and tamper-evident. An end 36 of the band 20 in contact with the wearer's skin will be rounded for comfort and non-abrasiveness (FIG. 1). To ensure visible indications of tampering, a non-adhesive end 38 of the band 20 (i.e., the end 38 adhered to the adhesive bonding agent 34 on the adhesive end 36) will be perforated or scored with incisions 40 that penetrate all layers 24, 26 of the band 20. For example, once the adhesive end 36 is connected to the non-adhesive end 38, attempts to remove the band 20 will cause the band 20 to tear along the incisions 40 and destroy the integrity of the band 20 or, if only minimally attempted, provide visible evidence of an attempt at tampering. The rounded end 36 of the band 20 is wrapped under the scored non-adhesive end 38 of the band 20 and then, by finger pressure, the adhesive 34 bonds the two ends 36, 38 together.

The top substrate 24 of the band also includes an area for printed indicia 42 that can be pre-printed or printed on after construction of the band 20. The indicia can be in the form of a variety of visual indicia including, without limitation, alphanumeric text, a barcode, a logo or the like.

Figure 3:
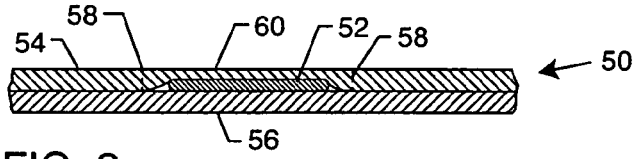
FIG. 3 is a sectional view similar to FIG. 2, showing another embodiment of a wristband of the present invention wherein a ticket is embedded within the wristband.
Figure 4:
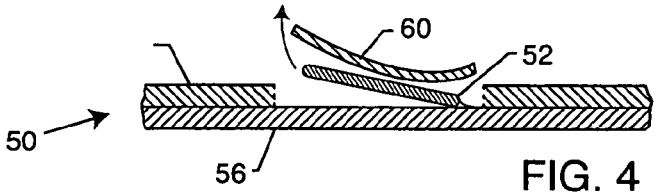
FIG. 4 is a sectional view similar to FIG. 3, showing the top layer of the wristband of FIG. 3 removed in order to access the ticket.

FIGS. 3 and 4 illustrate another embodiment of the present invention residing in a one-piece wristband 50, similar to the band 20 described above, with detachable tickets 52 embedded within the band 50. Like the band 20 of FIGS. 1 and 2, the band 50 of FIGS. 3 and 4 is constructed in two layers with a top substrate 54 and a bottom substrate 56 but the band 50 differs in that the tickets 52 are embedded as inserts within the band 50 between the top and bottom substrates 54, 56. Perforations 58 in the top substrate layer 54 allow sections 60 of the top layer 54 to be peeled off (FIG. 4) to reveal the tickets 52 embedded between the two substrates 54, 56 during manufacture of the band 50 and free the tickets 52 for use. The perforations 58 that pierce the top layer 54 do not penetrate the bottom layer 56. The section 60 of the top layer 54 covering the tickets 52 may be opaque (with or without indicia), translucent, or transparent so as to allow a person to see the underlying ticket 52. The section 60 of the top layer may also serve as a ticket.

Figure 5:
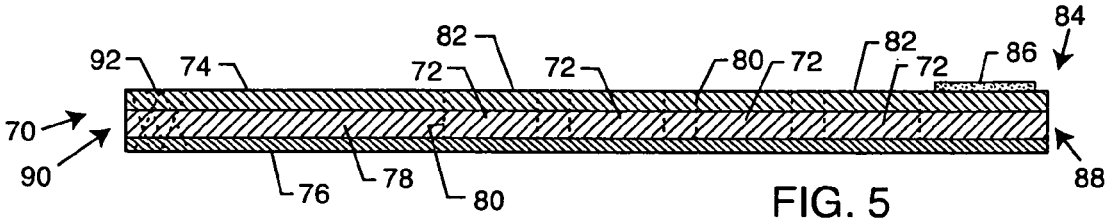
FIG. 5 is a cross-sectional side elevation view of another embodiment of a wristband embodying the present invention.
Figure 6:
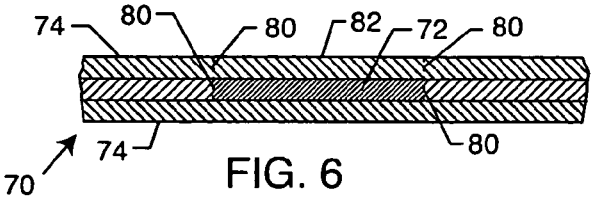
FIG. 6 is a sectional view of the wristband of FIG. 5.

In another embodiment of the present invention, seen in FIGS. 5 and 6, a one-piece wristband 70, similar to the bands 20 and 50 described above, with detachable tickets 72 embedded within the band 70 is constructed with three layers laminated together that include a top substrate 74, and a bottom substrate 76. The band 70 differs from those bands 20, 50 described above in that the tickets 72 are part of a center ticket insert substrate or layer 78 sandwiched between the top and bottom substrates 74, 76. Perforations 80 pierce the top and central substrates 74, 78 but not the bottom substrate 76 (i.e., the layer 76 closest to skin). These perforations 80 allow sections 82 of the top layer 74 to be peeled off to reveal the tickets 72 embedded between the substrates 74, 76 during manufacture of the band 70 and free the tickets 72 for use after being peeled away from the central layer 78. Alternately, tickets 72 can be embedded between the top layers 74 and the central layer 78 (which may or may not include tickets 72) or the central and bottom layers 78, 76 with the perforations 80 descending through the top and central layers 74, 78 (but at no time is the bottom layer 76 pierced). In addition to the embedded tickets 72, the section 82 of the top layer 74 covering the tickets 72 may be opaque (with or without indicia), translucent, or transparent so as to allow a person to see the underlying ticket 72. The section 82 of the top layer 74 may also serve as a ticket. The sections 82 of the top layer 74 covering the tickets 72 may be opaque (with or without indicia), translucent, or transparent so as to allow a person to see the underlying ticket 72.

As with the bands 20, 50 described above, the attachment device 84 for the band 70 is a pressure-activated adhesive 86 to assist the band 70 being tamper-resistant and tamper-evident. An end 88 of the band 70 in contact with the wearer's skin will be rounded for comfort and non-abrasiveness. To ensure visible indications of tampering, a non-adhesive end 90 of the band 70 (i.e., the end 90 adhered to the adhesive bonding agent 86 on the adhesive end 88) will be perforated or scored with incisions 92 that penetrate all layers 74, 76, 78 of the band 70. For example, once the adhesive end 88 is connected to the non-adhesive end 90, attempts to remove the band 70 will cause the band 70 to tear along the incisions 92 and destroy the integrity of the band 70 or, if only minimally attempted, provide visible evidence of an attempt at tampering. The rounded end 88 of the band 70 is wrapped under the scored non-adhesive end 90 of the band 70 and then, by finger pressure, the adhesive 86 bonds the two ends 88, 90 together.

Figure 7:
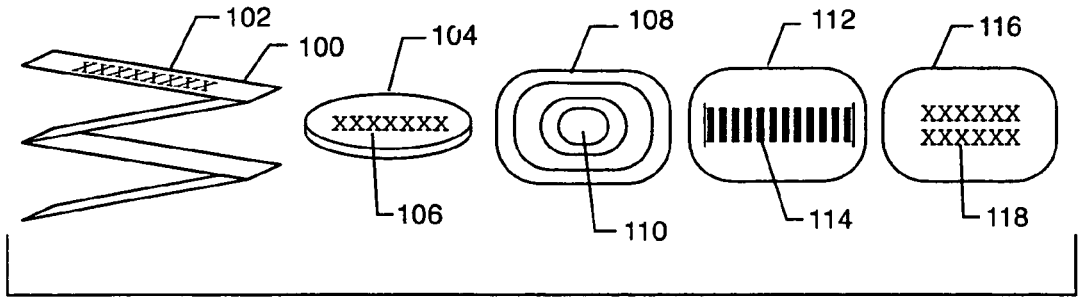
FIG. 7 illustrates several different types of tickets for use with a wristband embodying the present invention.

FIG. 7 illustrates several embodiments of tickets 22, 52, 72 used in conjunction with the present invention. The tickets 22, 52, 72 may be made of various materials including paper, plastic, metal or the like. The wristband 20, 50. 70 may bear tickets 22, 52, 72 inserts in various forms including, without limitation, a fan-folded paper or plastic ticket 100 with printed indicia 102; a paper, metal or plastic jeton 104 with imprinted indicia 106; a paper or plastic ticket 108 with an RFID inlet (embedded chip and antenna) 110 or other electronic readable media (e.g., magnetic strip), a ticket 112 imprinted with a barcode 114, a paper or plastic ticket 116 with printed indicia 118. For the purposes of this invention, the "ticket" may be used for various purposes including, without limitation, as a detachable insert, tag or label; a coupon; a jeton or coupon for prize redemption; as a token for rides, limited admissions and so forth; as fan-folded promotional literature; as "hidden" printed indicia that can be revealed only when detached; as visible printed indicia that can be detached from the band 20, 50, 70, and so forth. The "ticket" may also be used as one part of a collection of tickets or one part of a puzzle which can be redeemed for cash, prizes or other rewards when the collection/puzzle is completed. Tickets 22, 52, 72 may be adhesive-backed for attachment to another surface—or they may be of a firmer material for use as a jeton or the like. The indicia can be in the form of a variety of visual indicia including, without limitation, alphanumeric text, a barcode, a logo or the like. The indicia may also be of a special type that is only visible with ultra-violet or infra-red light. The RFID inlet 110 may be of a read only, read/write, a passive, or an active configuration. The RFID inlet(s) 110 may be attached to the surface of the ticket or embedded within the ticket during manufacture of the ticket, either individually or as part of a substrate. In the alternative, magnetic strips may be used in place of, or in conjunction with, RFID inlets 110.

Figure 8:
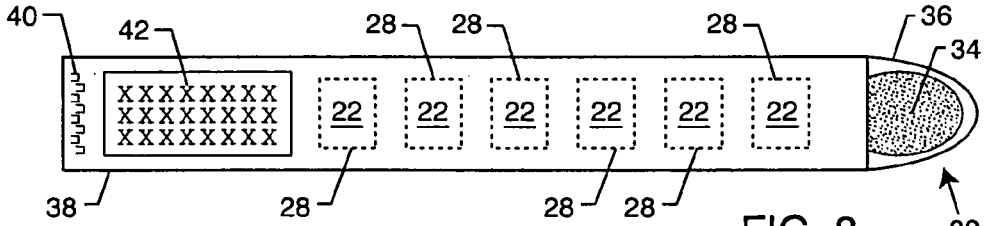
FIGS. 8–11 are top plan views of wristbands similar to FIG. 1, illustrating further embodiments of the present invention.
Figure 9:
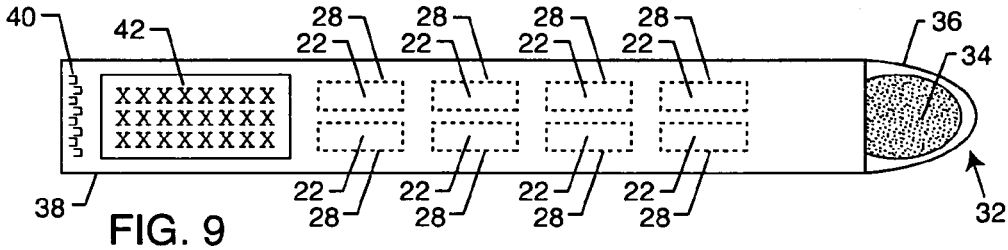
Figure 10:
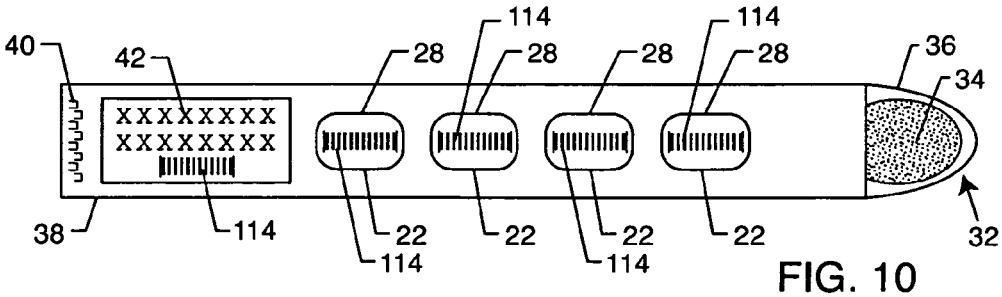
Figure 11:
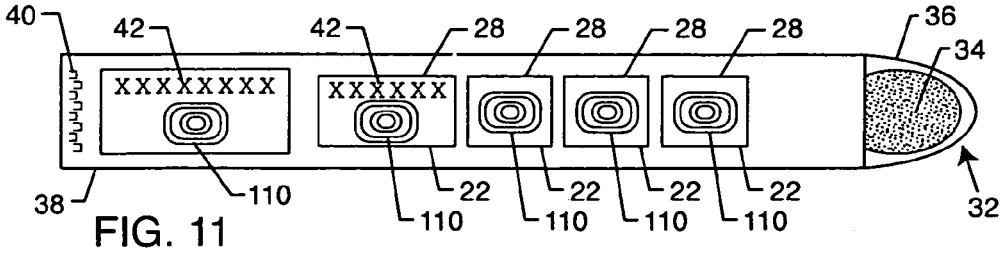

As seen in FIGS. 8–11, variations of the band 20 of FIG. 1 illustrate that the configuration of tickets 22 on a wristband 20 may be as varied as practical application allows and may accommodate printed indicia (including barcode), physical inserts (including RFID inlets) or combinations of them all. FIG. 8 illustrates the band 20 of FIG. 1 with a different number of perforations 28 defining the locations of a different number of tickets 22 in the band 20. As seen in FIG. 9, the band 20 includes a different number of tickets 22, a different configuration of the tickets 22 (i.e., pairs of tickets 22 along the length of the band 20) and the perforations 28 required in at least the top layer 24 to release the tickets 22 when needed/desired. FIG. 10 shows the band 20 of FIG. 1 where a bar code 114 is used on both the band 20 and the tickets 22. Human-readable indicia 42 is also be imprinted on the band 20 of FIG. 10 and, in the alternative, the indicia 42 may also be printed on the tickets 22. In FIG. 11, the band 20 is shown with RFID inlets 110 used with both the band 20 and the tickets 22. Human-readable indicia 42 may also be imprinted on the band 20 and tickets 22 of FIG. 11. The variations shown in FIGS. 8–11 are equally applicable to the bands 50, 70 of FIGS. 3–6.

Figure 12:
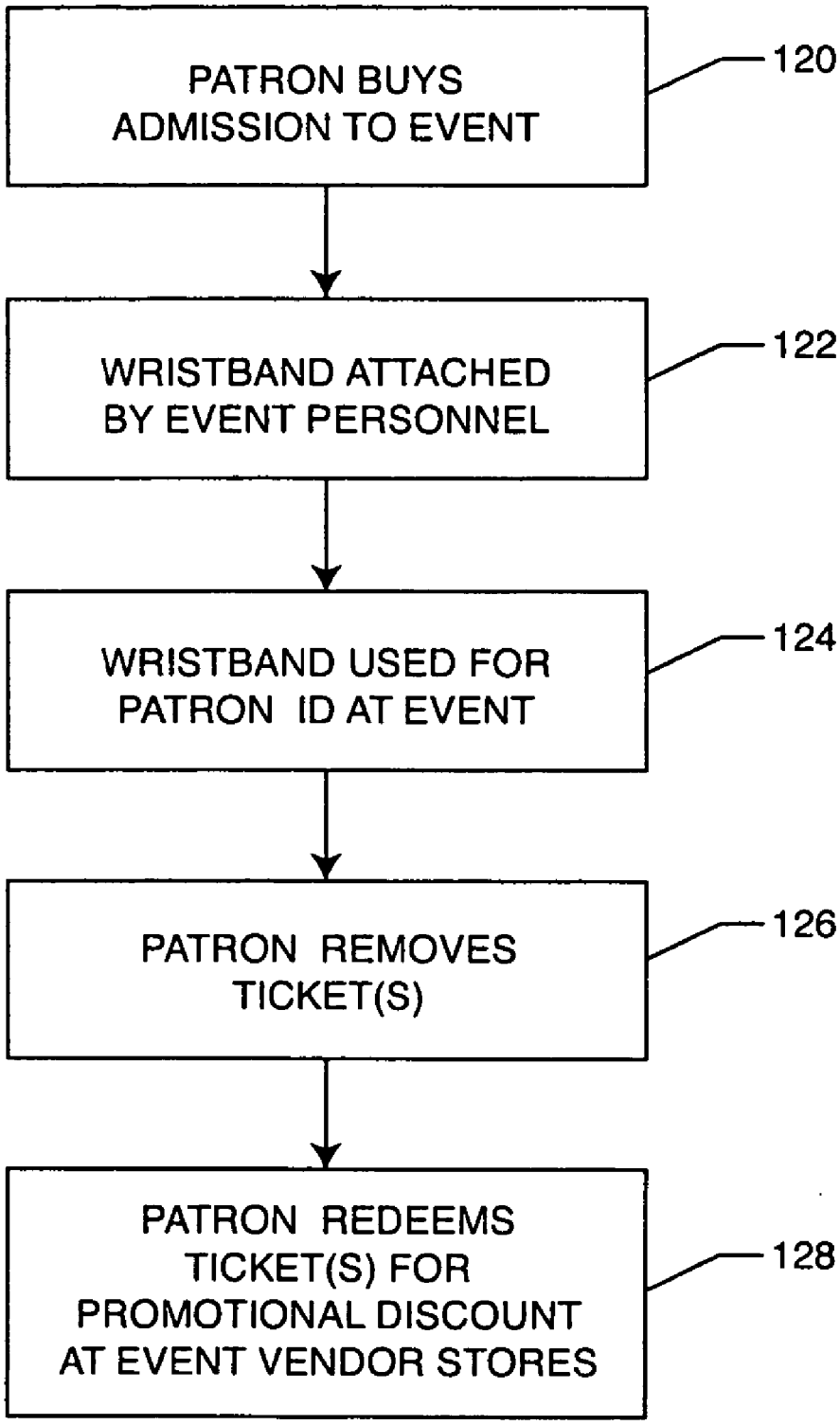
FIG. 12 is a flowchart of a process by which a wristband embodying the present invention can be used for the purchase of goods or services at event vendor stores.

In FIGS. 12–17, a number of different ways in which the wristbands bearing tickets embodying the present invention may be utilized are illustrated. These wristbands may be pre-packaged or created at the location where they are used, depending on the intended application of the wristband bearing tickets. In FIG. 12, a flow chart illustrates how tickets from a band, such as those described above, may be detached and redeemed for promotional discounts at an event. A patron buys admission to the event 120. A band bearing tickets, such as those described above, is attached to the patron by event personnel 122 at the point of admission. At the point of admission, a profile, account or the like may be created containing information relating to the patron. This information may later be used to check the identity of the patron and to match that patron with that band. The band is usually worn as a wristband, attached around the wearer's wrist with the top layer of the band exposed so that the patron/wearer, or authorized personnel, can reach the tickets that are integral with the wristband at some point during the band's use. The wristband is sufficient indication that the patron/wearer has been properly admitted to the event and the condition of the band indicates whether or not tampering has occurred (e.g., that a wristband has been removed and then been "recycled" for re-use). The wristband is used for patron identification at the event 124. This identification may involve human-readable or machine readable indicia on the band and/or RFID identification. Authorized personnel examine the band during the event in order to determine if the band is valid. After checking the band for visual indications of tampering, the authorized personnel will examine the human readable text, machine readable text and/or RFID identification embedded within the band and compare that information provided by the band with information collected by the event with respect to the authorized wearer of that band. It may be a simple matter of asking the patron for identification and comparing that identification with the band information or the authorized personnel may compare the band information with information stored by the event about the patron who was issued the band. During the event, the patron removes tickets(s) 126 from the band in order to purchase goods or services. The tickets may be coupons, coupon inserts, tokens, jetons, or the like and useful for a variety of purposes at the event. As outlined above, the tickets may have various indicia, text, barcodes, electromagnetic strips, RFID inlets or the like. For example, the patron is also able to redeem the ticket(s) for promotional discounts at vendor stores 128 during the event. The tickets of the band may be generic or the tickets may differ in purpose and/or form. The vendor may assist the patron in identifying which ticket(s) are appropriate for removal in order to obtain the promotional discount or indicia on the ticket may identify the ticket's function to the patron. The patron simply removes a section of the top layer of the band to access the ticket for use. The ticket may be the removed section of the top layer itself or the ticket may have been stored below the surface of the removed section of the top layer and removed once the top layer covering the ticket was removed. The ticket may then be exchanged on its face for the promotional discount, scanned by a barcode reader or scanned for RFID information related to the promotional discount.

Figure 13:
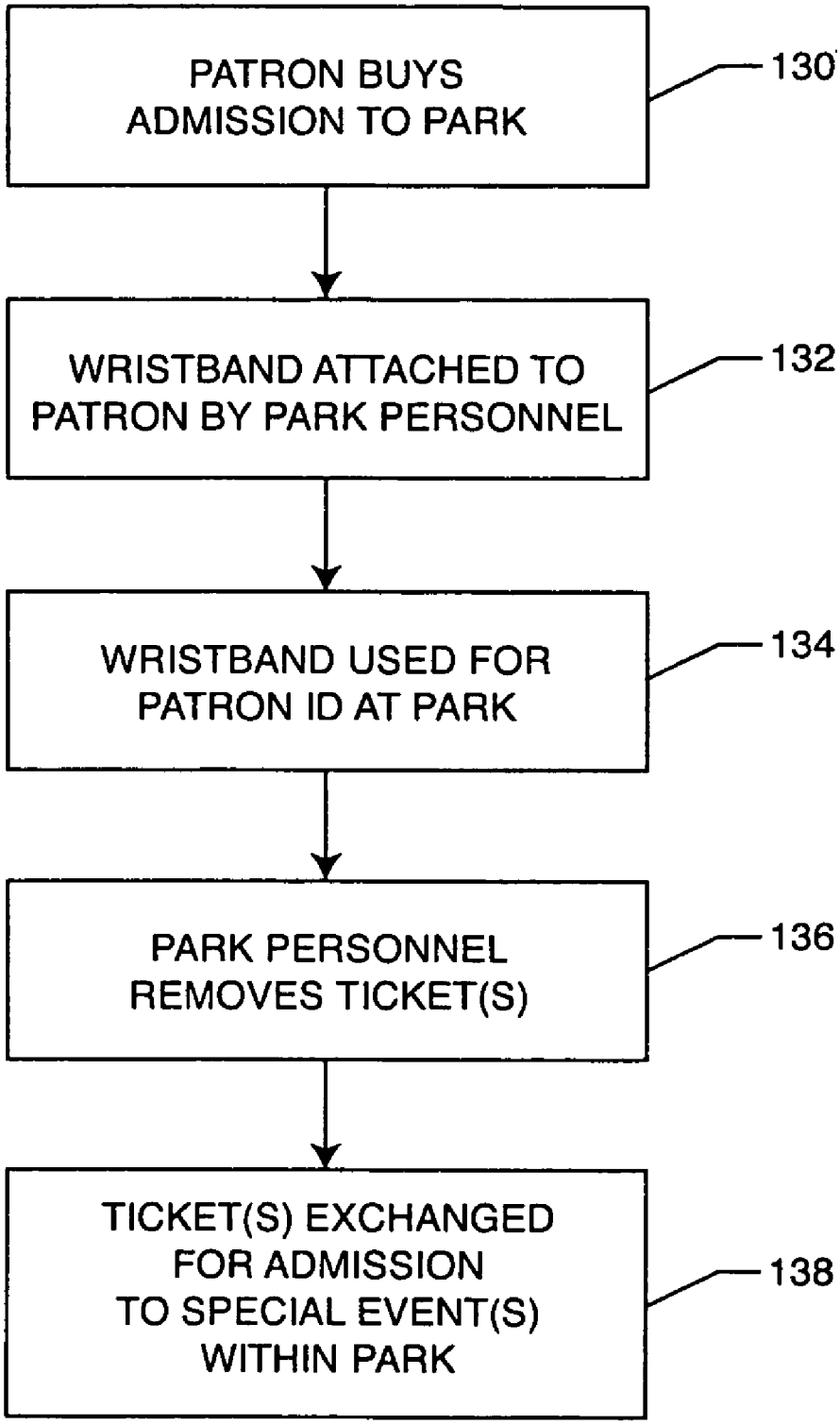
FIG. 13 is a flowchart of a process by which a wristband embodying the present invention can be used for the purchase of goods or services at special events within a park.

FIG. 13 illustrates an example of a crowd control or security use of the wristband bearing tickets is provided where authorized personnel detach the tickets, which are used for specified entry within a larger controlled environment. The wristband is employed for promotional and commercial uses, such as wearer-specific point-of-sale credits and debits. A patron buys admission to a theme park or the like 130. A wristband bearing tickets, such as those described above, is attached to the patron by park personnel 132 at the point of admission. The wristband is used for patron identification at the park 134. This identification may involve human-readable or machine readable indicia on the band or RFID identification. The park personnel and/or the patron remove tickets(s) 136 from the band at the park in order to purchase goods or services at the park, gain admission to rides, events or the like. The patron is also able to exchange the ticket(s) for admission to special event(s) within the park 138.

Figure 14:
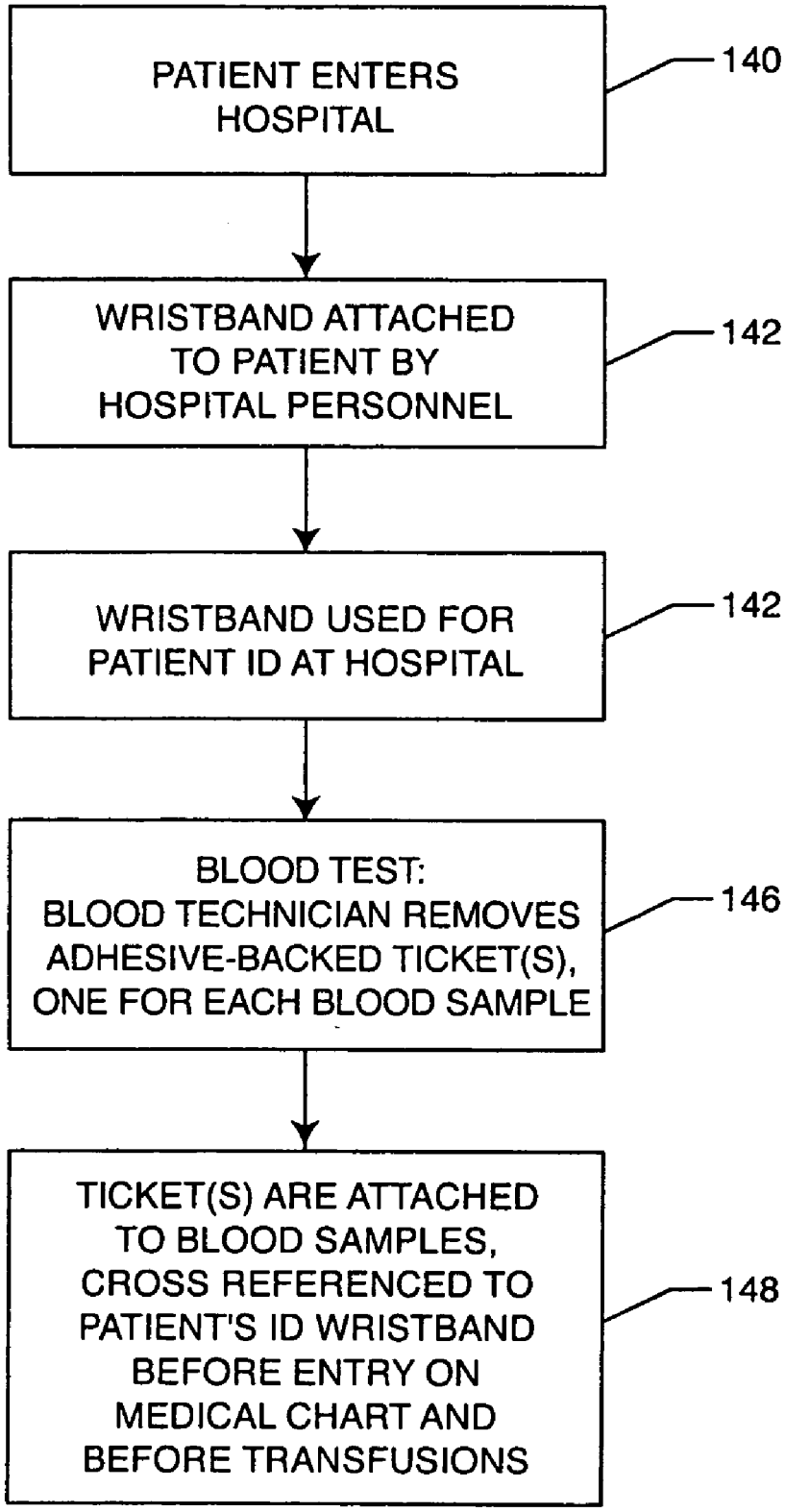
FIG. 14 is a flowchart of a process by which a wristband embodying the present invention can be used at a hospital to match blood samples with a patient.

FIG. 14 provides an example of a human-readable tracking usage of the band/tickets involving hospital personnel detaching tickets and adhering the tickets to test samples, cross-referencing samples and patient wearing the wristband. A patient enters a hospital for tests, treatment or the like 140. A wristband bearing tickets, such as those described above, is attached to the patient by hospital personnel 142 at the hospital admissions area. The wristband is used for patient identification at the hospital 144. This identification may involve human-readable or machine readable indicia on the band or RFID identification. The hospital personnel (e.g., blood technician) and/or the patient remove adhesive-backed tickets(s) from the band during procedures (e.g., blood test) where samples of bodily fluids (e.g., blood) and the like are taken and a ticket is attached to each sample taken 146. The ticket(s) are attached to samples (e.g., blood samples), and cross-referenced to the patient's identification wristband before entry on the patient's medical chart and before blood transfusions are given to the patient 148.

Figure 15:
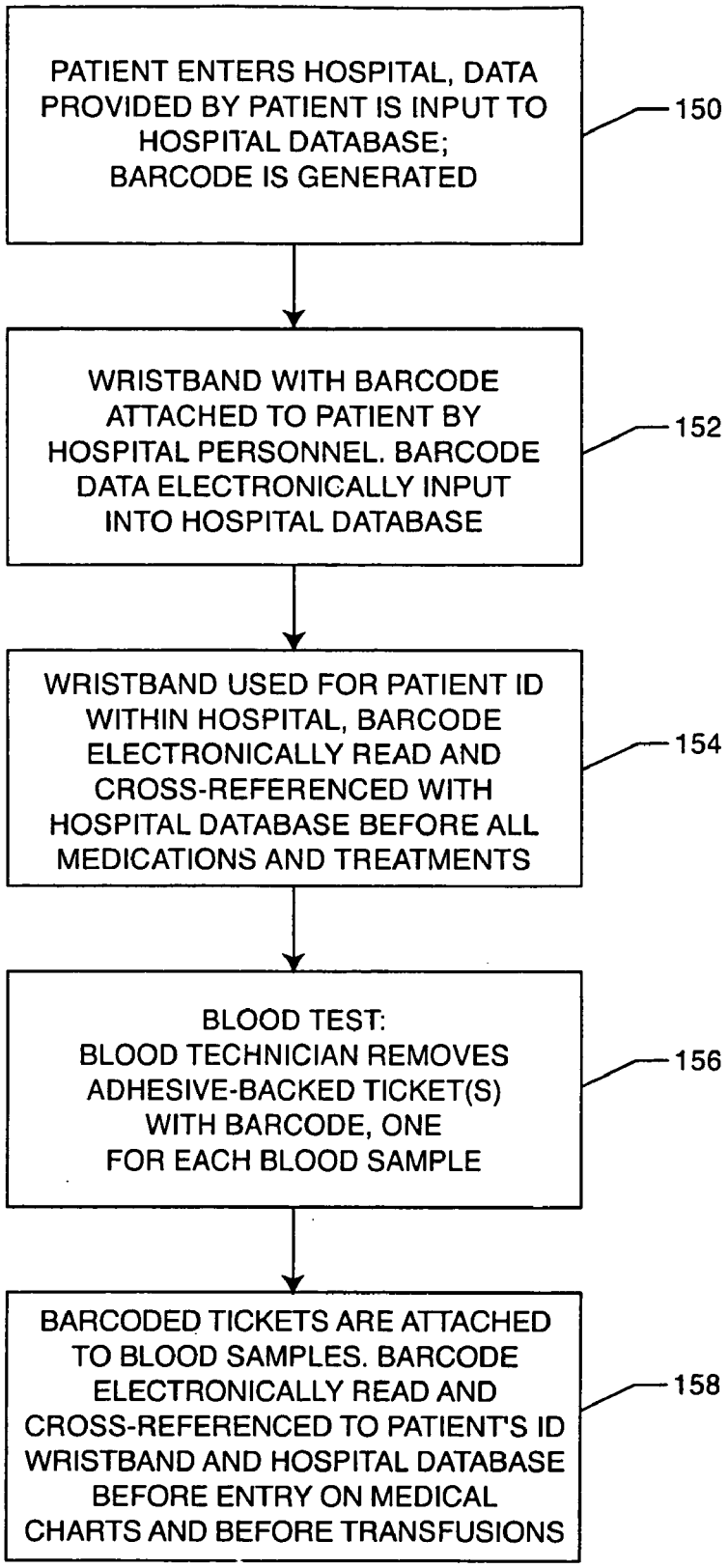
FIG. 15 is a flowchart of another process by which a wristband embodying the present invention can be used at a hospital to match blood samples with a patient using barcodes.
Figure 16:
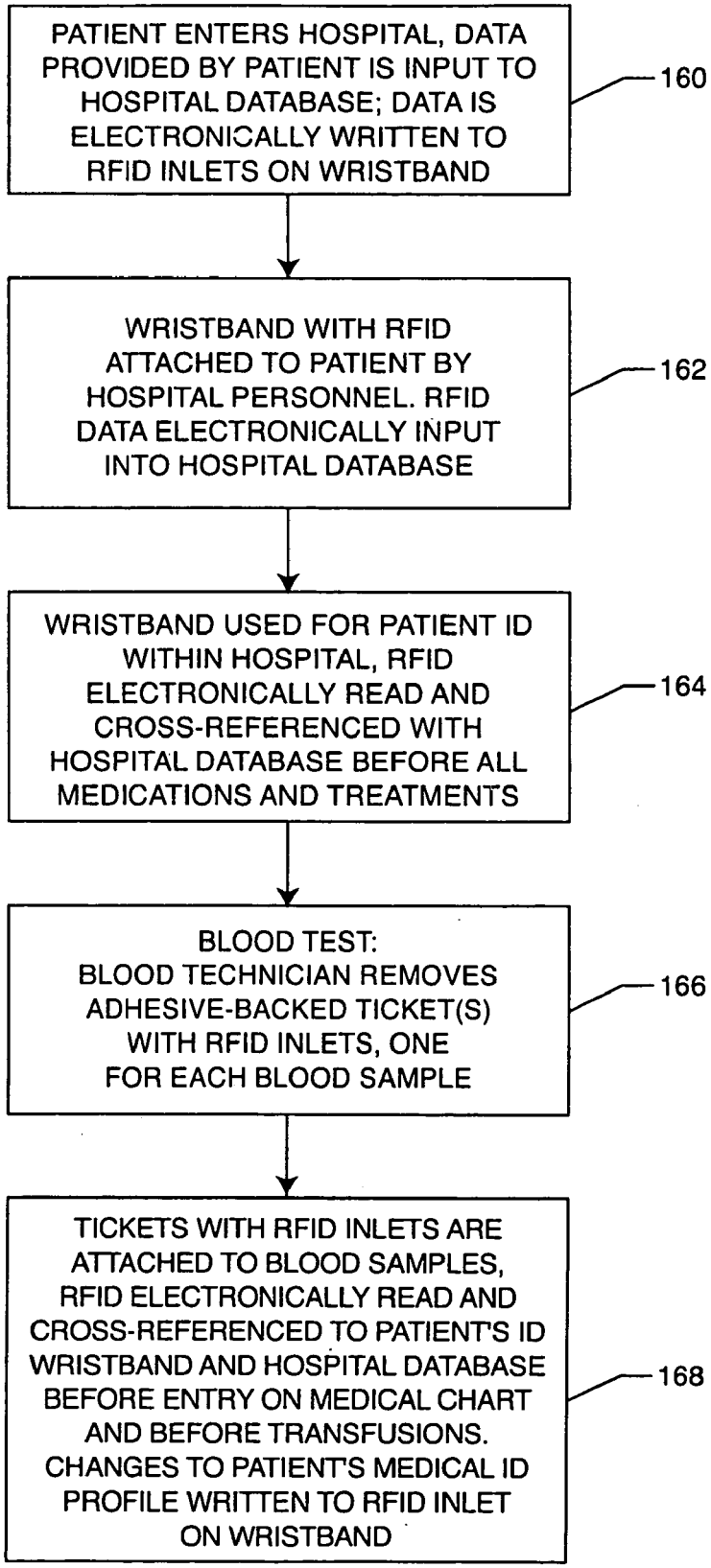
FIG. 16 is a flowchart of an additional process by which a wristband embodying the present invention can be used at a hospital to match blood samples with a patient using electronically readable devices.

FIGS. 15 and 16 employ on-demand creation of ticket data (i.e., printed indicia (human readable or barcode) imprinted on the face of the detachable ticket or electronic data encoded in the RFID inlet or other electronic data-carrying device). In these systems, the information is created just prior to the moments in which the band is attached to a wearer. The information that is placed on or within the band and its associated tickets is wearer-specific and may include additional data beyond basic identification (e.g., insurer, allergies, primary physician, et al.). The flowchart of FIG. 15 is similar to that of FIG. 14 but provides an example of a machine-readable tracking usage of the band/tickets involves patient data being encoded on read-only barcodes imprinted on the band and tickets, data that is also stored in the hospital database or data system. During a patient's stay in the hospital, a barcode on the band is electronically read to confirm the patient's identity, especially before the administration of medicines or medical procedures, while tickets are detached by the hospital's personnel and adhered to the patient's blood tests and the like, then cross-referenced with the hospital database. For example, the patient enters the hospital and, at the hospital admissions area, provides data that is input into the hospital's computer database and a patient-specific barcode based on that data is created by the computer for that particular patient 150. A wristband bearing that barcode and tickets (with or without that barcode) is attached to the patient by hospital personnel and the barcode data is electronically input into the hospital database 152. The wristband is used for patient identification within the hospital, with the barcode electronically read and cross-referenced with the hospital database before all medications and treatments are provided to the patient 154 The hospital personnel (e.g., blood technician) and/or the patient remove adhesive-backed tickets(s) bearing the barcode from the band during procedures (e.g., blood test) where samples of bodily fluids (e.g., blood) and the like are taken and a ticket is attached to each sample taken 156. The barcoded ticket(s) are attached to samples (e.g., blood samples), the barcode on the tickets electronically read and cross-referenced to the patient's identification wristband and hospital database before entry on the patient's medical chart and before blood transfusions are given to the patient 158.

In FIG. 16, a variation of the process of FIG. 15 is shown that uses read-write capabilities of RFID inlets that are utilized to update the patient's band data during stay. In the hospital setting, each ticket may be an adhesive-backed RFID inlet, coded to match an RFID inlet in the band—the band itself is coded into the hospital administrative system; at each hospital test, a ticket is detached from the wristband by professional personnel and adhered to the test specimen so that when the RFID inlet in the specimen is read into the hospital administrative system, the specimen is cross-referenced with the wearer of the band; ensuring positive identification. The patient enters the hospital and, at the hospital admissions area, provides data that is input into the hospital's computer database; data that is electronically written to RFID inlets on a wristband bearing tickets 160. A wristband bearing RFID inlets on both the band and tickets is attached to the patient by hospital personnel and the RFID data is electronically input into the hospital database 162. The wristband is used for patient identification within the hospital, with the RFID inlets electronically read and cross-referenced with the hospital database before all medications and treatments are provided to the patient 164 The hospital personnel (e.g., blood technician) and/or the patient remove adhesive-backed tickets(s) bearing the RFID inlet(s) from the band during procedures (e.g., blood test) where samples of bodily fluids (e.g., blood) and the like are taken and a ticket is attached to each sample taken 166. The tickets with RFID inlets are attached to the samples (e.g., blood samples), the RFID inlets on the tickets electronically read and cross-referenced to the patient's identification wristband and hospital database before entry on the patient's medical chart and before blood transfusions are given to the patient. Changes to the patient's medical identification profile in the hospital database are written to the RFID inlet on the wristband 168.

Figure 17:
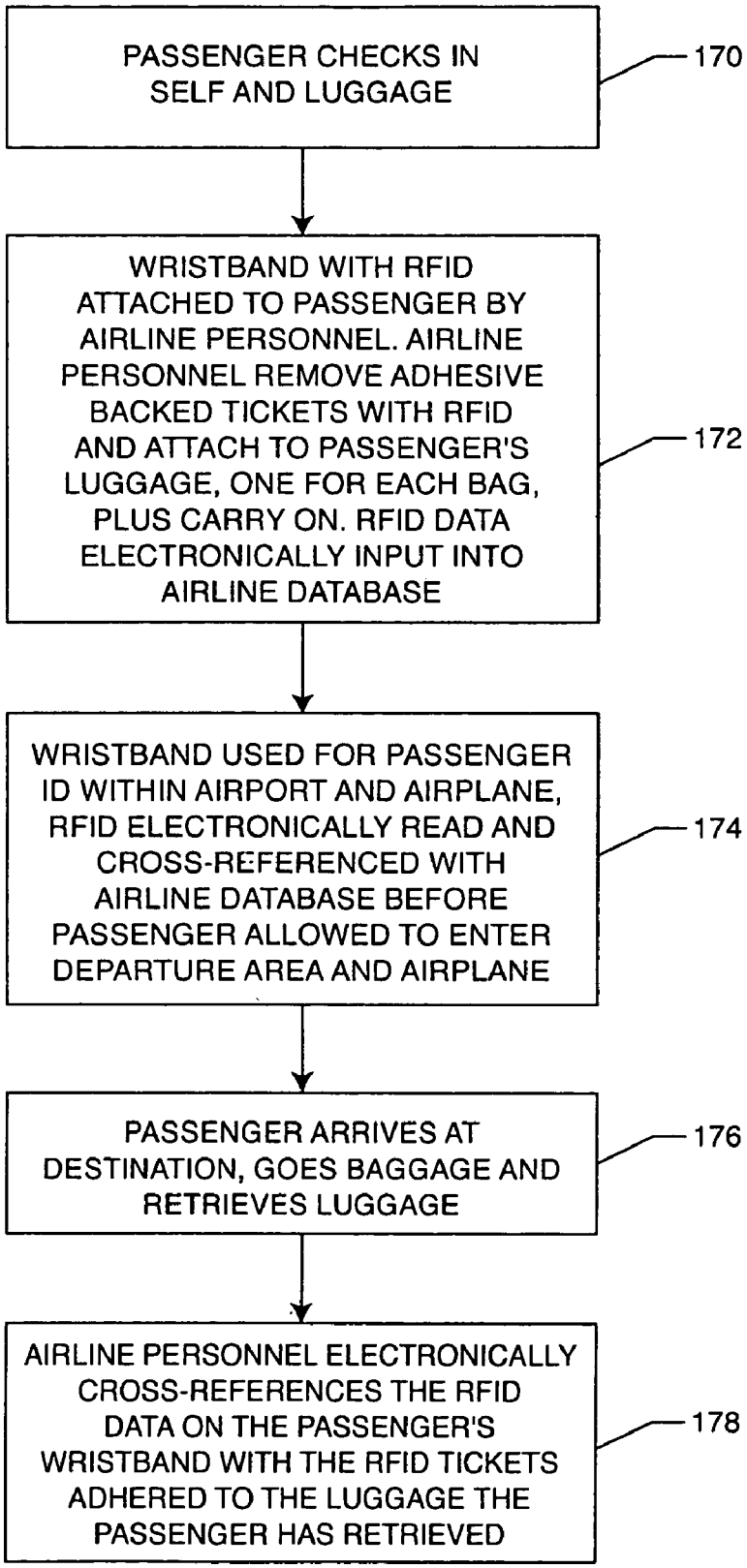
FIG. 17 is a flowchart of a process by which a wristband embodying the present invention can be used at an airport.

FIG. 17 illustrates a passenger/baggage tracking system that is keyed to the use of a wristband bearing tickets. This airline passenger/baggage-flow situation combines security and convenience tracking with a wristband that includes pre-coded, cross-referenced RFID inlets in the band and tickets that can be utilized simply and quickly. The passenger enters an airport and proceeds to an airline check-in desk where the passenger checks in his/her luggage 170 with airline personnel. Data regarding that passenger may or may not already be in the airline's computer database. A wristband bearing RFID inlets on both the band and the detachable tickets is attached to the passenger by airline personnel who also remove adhesive-backed tickets with RFID inlets and attach the tickets to the passenger's luggage (one ticket for each piece of luggage) and RFID data is electronically input into the airline database 172. The luggage is then sent to be loaded onto the passenger's intended flight. The wristband is used for passenger identification within the airport and airplane, with the RFID inlets electronically read and cross-referenced with the airline database before the passenger is allowed to enter the flight departure area or board the airplane 174. When the passenger arrives at his/her destination, the passenger goes to the baggage check-out area to retrieve his/her luggage 176. The airline personnel electronically read and cross-reference the RFID data on the passenger's identification wristband and the RFID tickets adhered to the luggage retrieved by the passenger prior to allowing the passenger to leave the baggage area with the luggage 178. Conversely, for baggage left behind or abandoned, the airline's tracking system can be further sophisticated to include logging of the passenger/baggage RFID code into the airline's database, so that the passenger/baggage can be electronically identified anywhere within the airline traffic system.

All of the various embodiments of the bands and their various components can contain bar code and/or RFID technology. The various embodiments of the bands may also include peel-off adhesive labels that have bar codes, embedded RFID chips, alphanumeric text and the like.

While the various embodiments of the present invention have been described in hospital, airport, theme park and concert settings, applications are possible in other. For example, the present invention is also applicable in business settings, advertising settings, law enforcement settings, field paramedical settings, or home settings where identification of various objects and articles is combined with the need to cross-reference the objects and articles. In a security situation, for example, a prisoner is assigned a wristband as he is removed from a holding cell and taken to court for trial. The wristband is attached to the prisoner. At each point where the prisoner is transferred between guard personnel, the prisoner or guard accompanying the prisoner detaches a ticket from the band and presents the ticket to the new guard, thus ensuring a track of the prisoner's transfer movements. The presentation of the tickets may be entered into a database at each point of transfer in order to maintain a near real-time fix on the location of the prisoner.

The above-described embodiments of the present invention are illustrative only and not limiting. It will thus be apparent to those skilled in the art that various changes and modifications may be made without departing from this invention in its broader aspects. Therefore, the appended claims encompass all such changes and modifications as falling within the true spirit and scope of this invention.

What is claimed is:

1. A process for effecting ticket-based transactions, comprising the steps of:

providing a band having a first end, a second end and opposing sides, the band having a plurality of removable tickets formed therein intermediate the first and second ends and between the opposing sides thereof;

attaching a band to a definite object including coupling the first and second ends of the band;

associating the band with the definite object in an electronic database;

removing a ticket from the band to effect a transaction; and utilizing the ticket to record the transaction in the electronic database.

2. The process of claim 1, wherein the utilizing step includes the step of scanning the removed ticket with a reader.

3. The process of claim 1, wherein the removing step includes the step of redeeming the ticket for goods.

4. The process of claim 3, wherein the redeeming step includes the step of exchanging the ticket for a discount on goods.

5. The process of claim 1, wherein the removing step includes the step of redeeming the ticket for services.

6. The process of claim 5, wherein the redeeming step includes the step of exchanging the ticket for a discount on services.

7. The process of claim 1, including the step of reading the band to identify the definite object.

8. The process of claim 1, wherein the reading step includes the step of scanning the band to identify the definite object.

9. The process of claim 1, including the step of attaching the removed ticket to an article.

10. The process of claim 9, including the step of cross-referencing the definite object with the article.

11. The process of claim 10, wherein the transaction comprises the steps of checking-in the article and claiming the article.

12. The process of claim 10, wherein the transaction comprises the steps of testing the article and entering test results into the database.

13. The process of claim 10, wherein the cross-referencing step includes the step of comparing the band-specific indicia of the ticket with indicia on the band.

14. The process of claim 10, wherein the cross-referencing step includes the step of comparing electronic information stored within the band with electronic information stored within the ticket.

15. The process of claim 1, wherein the utilizing step includes the step of cross-referencing the ticket with the band during the transaction.

16. The process of claim 1, wherein the utilizing step includes the step of cross-referencing the ticket with the database during the transaction.

17. The process of claim 1, wherein the removing step includes the step of removing a portion of a top layer of the band to remove the ticket for effecting the transaction.

18. The process of claim 1, wherein the removing step includes the step of removing a portion of a top layer of the band to access the ticket for effecting the transaction.

19. A process for effecting ticket-based transactions, comprising the steps of:

attaching a band to a definite object, the band having a plurality of removable tickets each bearing band-specific indicia usable in effecting a transaction;

associating the band with the definite object in an electronic database;

reading the band to identify the definite object;

removing a ticket from the band to effect a transaction;

utilizing the ticket to record the transaction in the electronic database; and cross-referencing the ticket with the band during the transactions;

wherein the removing step includes the step of removing a portion of a top layer of the band to access the ticket for effecting the transaction.

20. The process of claim 19, wherein the utilizing step includes the step of scanning the removed ticket with a reader.

21. The process of claim 19, wherein the removing step includes the step of redeeming the ticket for goods or services.

22. The process of claim 21, wherein the redeeming step includes the step of exchanging the ticket for a discount on the goods or services.

23. The process of claim 19, wherein the reading step includes the step of scanning the band to identify the definite object.

24. The process of claim 19, including the step of attaching the removed ticket to an article.

25. The process of claim 24, including the step of cross-referencing the definite object with the article.

26. The process of claim 25, wherein the transaction comprises the steps of checking-in the article and claiming the article.

27. The process of claim 25, wherein the transaction comprises the steps of testing the article and entering test results into the database.

28. The process of claim 25, wherein the cross-referencing step includes the step of comparing the band-specific indicia of the ticket with indicia on the band.

29. The process of claim 25, wherein the cross-referencing step includes the step of comparing electronic information stored within the band with electronic information stored within the ticket.

30. The process of claim 19, wherein the utilizing step includes the step of cross-referencing the ticket with the database during the transaction.

31. The process of claim 19, wherein the removing step includes the step of removing a portion of a top layer of the band to remove the ticket for effecting the transaction.

32. The process of claim 19, wherein the band has a first end, a second end and opposing sides, the band having a plurality of removable tickets formed therein intermediate the first and second ends and between the opposing sides thereof.

33. A process for effecting ticket-based transactions, comprising the steps of:

providing a band having a first end, a second end and opposing sides, the band having a plurality of removable tickets formed therein intermediate the first and second ends and between the opposing sides thereof;

attaching a band to a definite object including coupling the first and second ends of the band;

associating the band with the definite object in an electronic database;

reading the band to identify the definite object;

removing a portion of a top layer of the band to remove a ticket from the band for effecting a transaction;

scanning the removed ticket with a reader;

utilizing the ticket to record the transaction in the electronic database;

cross-referencing the ticket with the band during the transaction; and cross-referencing the ticket with the database during the transaction;

wherein the removing step includes the step of removing a portion of a top layer of the band to access the ticket for effecting the transaction.

34. The process of claim 33, wherein the removing step includes the step of redeeming the ticket for a discount on goods or services.

35. The process of claim 33, including the steps of attaching the removed ticket to an article and cross-referencing the definite object with the article.

36. The process of claim 35, wherein the transaction comprises the steps of checking-in the article and claiming the article.

37. The process of claim 35, wherein the transaction comprises the steps of testing the article entering test results into the database.

38. The process of claim 35, wherein the ticket and band cross-referencing step includes the step of comparing the band-specific indicia of the ticket with indicia on the band.

39. The process of claim 35, wherein the ticket and band cross-referencing step includes the step of comparing electronic information stored within the band with electronic information stored within the ticket.

* * * * *